US005139671A

United States Patent [19]

Henricson et al.

[11] Patent Number: 5,139,671

[45] Date of Patent: Aug. 18, 1992

[54] APPARATUS FOR TREATING PULP

[75] Inventors: Kaj O. Henricson, Kotka; Seppo K. Kokkonen, Savonlinna; Olavi E. Pikka, Karhula; Harri T. Qvintus; Erkki A. Ruuskanen, both of Savonlinna; Erkki E. Savolainen, Haapakallio, all of Finland

[73] Assignee: A. Ahlstrom Corporation, Noormarkku, Finland

[21] Appl. No.: 558,142

[22] Filed: Jul. 26, 1990

Related U.S. Application Data

[63] Continuation-in-part of Ser. No. 224,467, Jul. 26, 1988, Pat. No. 4,952,314.

[30] Foreign Application Priority Data

Nov. 11, 1987 [FI] Finland ..... 874967

[51] Int. Cl.[5] ..... B01D 33/056

[52] U.S. Cl. ..... 210/398; 210/400; 210/404

[58] Field of Search ..... 210/398, 400, 401, 402, 210/404

[56] References Cited

U.S. PATENT DOCUMENTS

| | | | |
|---|---|---|---|
| 3,296,066 | 1/1967 | Green et al. | 162/338 |
| 3,487,941 | 1/1970 | Haapanaki | 210/404 |
| 3,741,865 | 6/1973 | Lejeune | 210/400 X |
| 4,266,413 | 5/1981 | Yli-Vakkuri | 68/158 |
| 4,502,171 | 3/1985 | Koskinen et al. | 210/404 X |
| 4,596,631 | 6/1986 | Prough et al. | 162/52 |

*Primary Examiner*—Charles Hart
*Attorney, Agent, or Firm*—Akoo-Toren

[57] ABSTRACT

An appratus for treating medium consistency pulp in connection with different treatment apparatuses, such as washers. According to the prior art the treatment of pulp, for example, the washing process, starts at a low consistency, approximately 1–3% so that it is necessary always to dilute pulp before washing, whereby the water consumption of the plant increases and the need of power in, for example, pumping and in the treatment generally increases. The present invention makes it possible to treat medium consistency pulp, because the feeding means is able to spread the pulp as an even layer on the perforated surface of the treating apparatus.

12 Claims, 2 Drawing Sheets

APPARATUS FOR TREATING PULP

This is a continuation-in-part application of application Ser. No. 07/224,467, filed Jul. 26, 1988, U.S. Pat. No. 4,952,314.

BACKGROUND OF THE INVENTION

The present invention relates to an apparatus for treating medium consistency pulp in connection with different pulp treatment devices or apparatuses. Washers used for washing pulp are disclosed below as an example.

Several types of washing apparatuses are known from the prior art. Known arrangements include diffusers, drum washers/disc washers and Fourdrinier washers, which clearly differ from each other. Pulp is fed into diffuser washers at a consistency of 10%. The feed consistency for drum washers and Fourdrinier washers is normally between 1 and 3%. Drum washers presently used are, for example, suction washers, wash presses and pressure washers.

A conventional suction washer includes a wire coated drum rotatable in a vat or drum. The casing of the drum includes collecting compartments beneath a perforated plate, which each communicate via their own pipe with the valve system on the shaft at the end of the drum. The filtrate is led from the valve through the drop leg to the filtrate chest. Due to the valve construction the suction effect of the drop leg may be arranged at different positions of the web formation.

Web formation in a suction washer is carried out by arranging—by means of a drop leg—reduced pressure inside the drum rotating in the vat, which reduced pressure draws pulp suspension from the vat and against the drum. The fibers of the pulp thicken on the surface of the drum when the liquid penetrates the drum. The consistency of the fiber suspension in the vat is about 0.5–2%, and the consistency of the pulp layer thickened on the drum is about 10–12%. The web formation zone, in other words the part of the rim of the drum, which in the vat is covered by fiber suspension, is about 140°. The maximum rotational speed of the drum is 2 to 2.5 r/min. If the rotational speed is higher the collecting compartments and pipes of the filtrate are not able to empty.

Washing is carried out as a displacement wash by showering washing liquid on the surface of the drum protruding from the vat, which due to the reduced pressure is absorbed through the pulp layer and displaces a majority of the chemical liquid. The width of the displacement zone is approximately 120°. The typical specific square capacity of the suction washer is about 5 BDMT/m$^2$/d, wherein the thickness of the pulp web is about 25 mm. In bleaching, the square capacity of the suction washer is about 8 BDMT/m$^2$/d and the thickness of the web is about 30 mm. A washer press comprises a drum with a wire coated or drilled perforated plate casing. The pulp feed is carried out at a consistency of 3 to 4% and the knots, unbeaten particles and respective undesired parts are to be discharged from the pulp prior to the washer. There are compartments on the casing of the drum, from which the filtrate is led out via a chamber at the end rim. The drum may also be open so as to gather the filtrate in the drum and let it flow out through the opening at the end.

The length of the web formation stage is about 90° and that of the displacement stage about 150°. The rotational speed of the drum is about 2 r/min and the specific square capacity about 15 to 20 BDMT/m$^2$/d. The consistency of the washed pulp may rise even to 30%, when a press roll is used. The displacement, however, takes place at the consistency of 10%, the thickness of the pulp web being about 50 mm.

As an example of a pressure washer there may be mentioned an apparatus according to Finnish patent publication 71961, which mainly comprises a drilled perforated plate drum having 15 to 20 mm high moldings attached on the surface at the distance of about 200 mm from each other. Filtering compartments are located on the casing of the drum beneath the pulp compartments. The outer rim at the end of the drum includes a valve arrangement through which the filtrate is discharged. The washer may have 3 to 5 stages, in other words the filtrates are led from stage to stage by pumping upstream. The chambers of the washing liquid between different stages are sealed.

Web formation is carried out by feeding pulp into the feed box, the bottom of which is formed of a perforated plate, on which an endless wire cloth is located. The feed box becomes lower towards the washing drum. Liquid is discharged from the pulp in the feed box through the wire cloth and the perforated plate and the pulp is thus thickened on the wire cloth. With the wire cloth moving towards the drum, liquid is continuously discharged from the suspension also due to the pressure caused by the lowered feed box. At the end of the feed box pulp is led to the compartments between the moldings and axial "planks" of length of the drum are thus formed in the compartments. Immediately downstream of the feeding point, the drum has a first washing zone; the apparatus according to said patent publication has five separate zones. A flow of washing liquid is led to each zone, which when pressed through the pulp layer in the compartments of the washing drum displaces the previous liquid there. As mentioned above the filtrates are led upstream from one zone to another. In other words, pure washing liquid is pumped to the last washing zone and the displaced filtrate is led to the second last zone to operate as washing liquid there. Subsequent to the last washing zone the "pulp planks" are removed from the drum, for example, by compressed air blow and are transferred forwards with a screw conveyer.

The specific square capacity of this type of pressure washer when having four stages, is about 2.4 BDMT/m$^2$/d. The thickness a "pulp plank" is about 55 mm, and it may reach a consistency of 15 to 17%. The washing water flowing from the compartments, however, dilutes the consistency to 10 to 12%. The consistency of the pulp being fed to the washing drum is 3 to 6%. The rotational speed being used with the drum is about 0.3 rpm.

All said apparatuses, apart from the diffusers are characterized in that the consistency of the pulp being fed to the washer is relatively low, at its maximum 6%. In other words the pulp is to be diluted prior to the washing to less than half of the value of the preceding treating stages, which is 10 to 15%. Thus the amount of liquid in the pulp at least doubles. If it were possible to carry out the washing at high consistency, savings might be gained both in the size of the equipment, in the energy consumption and also in the amount of the filtrate to be led for evaporation. The problem is, however, that there has not been appropriate equipment to feed high consistency, over 6%, pulp to the washer. On the other hand, it is also a known fact that when the pulp thickens the air content of the suspension grows and foam problems arise in the washing. Also other pulp treating devices, such as thickeners, have similar problems.

SUMMARY OF THE INVENTION

The object of the present invention is to eliminate or minimize these problems and to enable the treatment of pulp in the medium consistency zone of approximately 8 to 20%. The apparatus according to the invention feeds the medium consistency pulp in a controlled manner to the treating apparatus.

The object of the invention has been reached by an apparatus comprising means for feeding pulp to said filtering means, said feeding means being formed of a substantially air-tight pressure chamber and a feed duct for supplying pulp to said pressure chamber, said pressure chamber having walls, of which at least one is formed of said filtering means.

The apparatus in accordance with a preferred embodiment of the present invention comprises an outer housing surrounding a stationary liquid pervious cylindrical surface having a rotating liquid pervious cylinder therewithin, said liquid pervious cylindrical surface and said rotating cylinder defining a treatment space for pulp therebetween. Said outer housing and said stationary cylindrical surface form an outer and inner wall of annularly arranged chambers for feeding treating liquid to the pulp in said treatment space. Said treatment space is divided into a number of treatment compartments by means of substantially radial partition walls extending from said rotating cylinder towards said stationary cylindrical surface. The pressure chamber has a bottom wall and a side wall, and is attached by means of its side wall to the outer housing in an air-tight manner so that said rotating cylinder forms said bottom wall of said pressure chamber.

The apparatus in accordance with another preferred embodiment of the invention comprises a feed end, a discharge end, a first wire arranged to travel over a first set of rolls and a second wire arranged to travel over a second set of rolls. The wires form a treatment space therebetween which tapers towards said discharge end and form a wedge shaped gap therebetween at said feed end. The wires have seals at the sides thereof for preventing the pulp from leaking from the sides of said wires. The pressure chamber has a bottom wall and a side wall, said bottom wall being formed partially of said wires and partially of said wedge shaped gap between said wires at said feed end.

The apparatus according to the invention is described in detail below, by way of example and with reference to the enclosed drawings, in which a washer is used as an example.

DETAILED DESCRIPTION OF THE PREFERRED EMBODIMENTS

Figure 1:
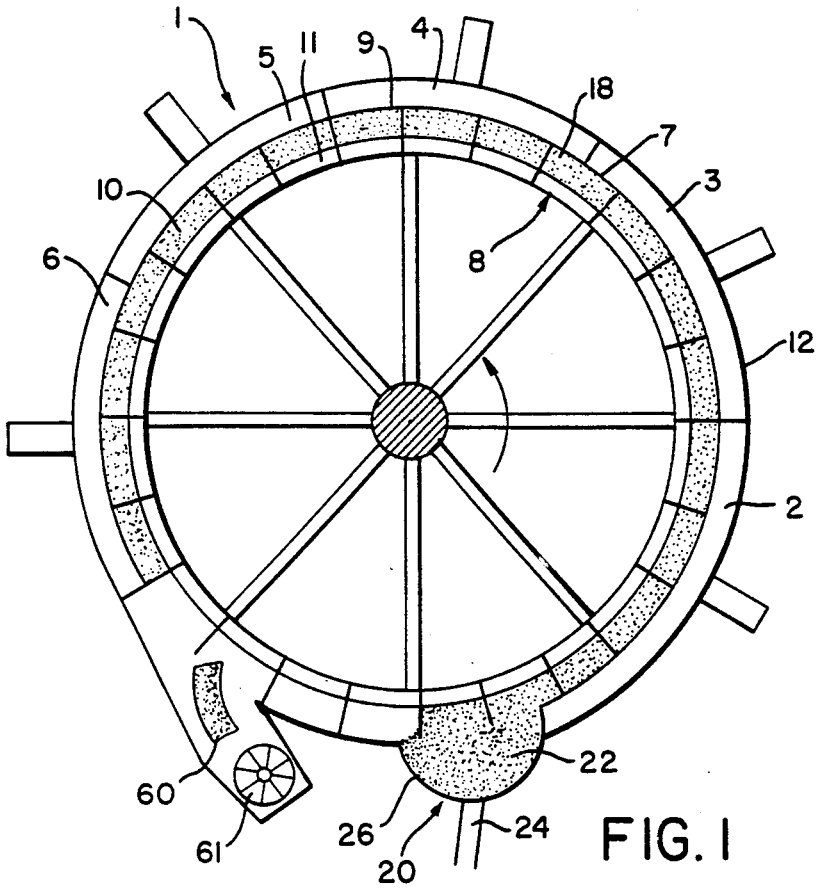
FIG. 1 is a schematic sectional view of a preferred embodiment of the present invention arranged in connection with a drum type pulp treating apparatus.

In the following, the invention is mainly disclosed in connection with a pulp washer, but also other pulp treatment apparatuses may come into question. A washer 1 according to FIG. 1 is, in principle, a drum in accordance with U.S. patent application Ser. No. 921,786. The housing 12 of said drum, being preferably pressure-proof, surrounds an annular space divided into chambers 2–6, to which a number of conduits lead. The inner surface of said chambers 2–6 is formed of a cylinder 7 which is permeable to liquid. Inside this cylinder 7 is a rotatably mounted cylinder 8 with an outer surface 18 permeable to liquid. There are axially extending, radial partition walls 9 protruding outwardly from the surface of the rotating perforated liquid pervious cylinder, which partition walls form together with portions of the cylinder surfaces 7 and 18, pulp treating compartments 10, i.e. pulp treating zones or treatment space. To the inside of the outer rim 18 of the cylinder 8, there are arranged liquid chambers 11, from which liquid is led through a valve system (not shown) at the end of the washer from each washing zone (corresponding chambers 2–6) to the preceding zone. In other words, from the last washing zone, from the area of chamber 6 to chamber 5, from the area of chamber 5 to chamber 4, etc. The pulp may be discharged from the apparatus as described in FIG. 1, for instance. The pulp in the form of "planks" 60 falls from the treating compartments 10 along a chute to a screw conveyor 61, which feeds the pulp out of the apparatus. Of course the discharge apparatus shown in the parent patent may also be used.

Figure 2:
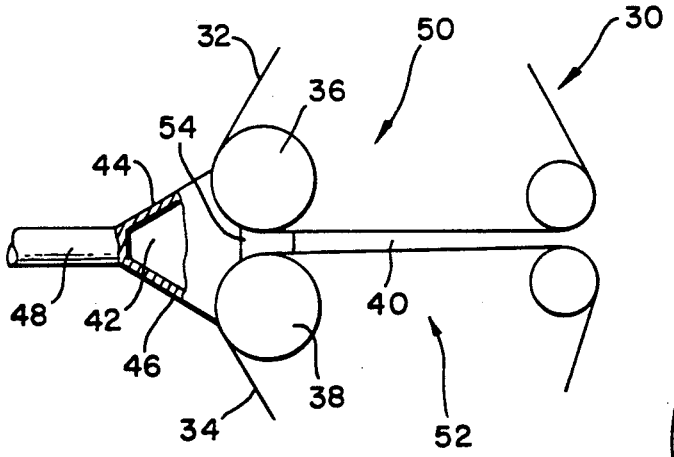
FIG. 2 is a schematic sectional view of another preferred embodiment of the present invention arranged in connection with a belt type pulp treating apparatus.
Figure 3:
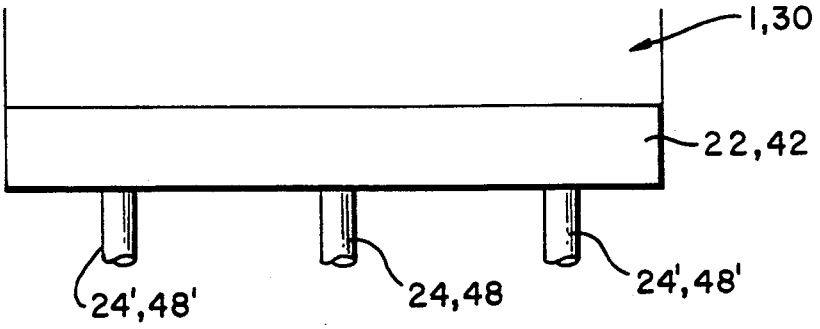
FIGS. 3, 3*a* and 4 are schematic illustrations showing alternative locations for feed ducts for introducing pulp into the pressure chamber.
Figure 3A:
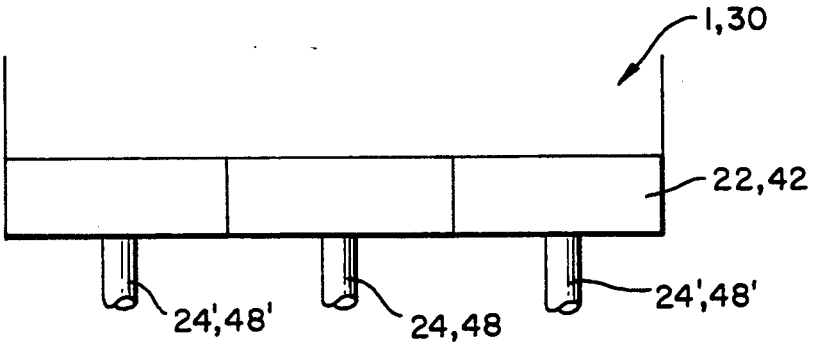

Compared with the apparatus according to said patent major changes, shown in FIGS. 1–3, have been made to the feed side of the washer. FIG. 1 shows a rough outline of pulp feed means 20, which comprises a feed chamber 22 connected directly to the housing 12 of the apparatus in operative communication with the rotating cylinder surface 18. Such feed means 20 makes possible the feeding of pulp into the washer and the spreading of the pulp into a uniform layer on the rotating cylinder surface 18 at the consistency of the pulp of the immediately preceding mass tower or washing step, in other words air free at a consistency of 8 to 20%. A very important feature of the feed means 20 is its tightness to air. In other words, the feeding of pulp is performed by pumping the medium consistency pulp via duct 24 to a pressure chamber 22 where the pulp is made to spread into a uniform layer in the treatment chambers 10 without contact to outside air. The pulp pumping equipment is preferably provided with gas discharge means so that the pulp introduced into the apparatus is gas free. As the pulp is thick it is advantageous to use a so called MC pump for pumping (MC pumps are manufactured and sold by AHLSTROM PUMPS Inc., Peace Dale, R.I.). The pulp flowing to the pressure chamber 22 does not include harmful amounts of air anymore, neither is there a risk of foaming of the filtrate. As shown in FIG. 1, the pressure chamber 22 may be formed of a substantially semicircular wall portion 26, the axial length of which substantially equals the length of the entire apparatus. However, it is to be noted that other forms of walls may be used, for instance straight walls as described with regard to the embodiment of FIG. 2. It is also possible to divide the pressure chamber into a number of shorter chambers each having an inlet duct for receiving the pulp (see FIG. 3*a*).

FIG. 2 shows another preferred embodiment in accordance with the invention, where said feed means are arranged in connection with a belt-type dewatering or washing apparatus.

Said belt type treating apparatus is provided with a first wire section 50 having a wire 32 arranged to travel over a first set of rolls, only two rolls being shown, and a second wire section 52 having a wire 34 arranged to travel over a second set of rolls. Said wire sections 50 and 52 have been arranged with respect to each other such that there is a wedge shaped gap between the wires 32 and 34 at both ends of the apparatus, but the gap 54 at the feed end being larger than the one at the discharge end. Thus, the pulp treatment space between the wires 32 and 34 tapers towards the discharge end. The pulp is normally fed between the wires 32 and 34 from a headbox resembling somewhat the feed devices of a paper making machine. A headbox, if used, precludes that the pulp has to be diluted to a low consistency. In addition to the fact that a headbox mentioned cannot be used for treating medium or high consistency pulps, as the pulp would not flow out of the headbox, the pulp would be in contact to outside air, if it were fed in a conventional manner between the wires.

The embodiment shown in FIG. 2 comprises a belt type washer 30 having the upper wire 32 i.e. the first wire section 50, and the lower wire 34 i.e. the second wire section, travelling around end rolls 36 and 38. The sides of the wires 32 and 34 are sealed by means of a side seal 40 so that the pulp between the wires 32 and 34 cannot escape to either side of the apparatus. The side seal 40 is preferably arranged to extend somewhat outside the apparatus at the feed end, where there is arranged a pressure chamber 42 for feeding and spreading the pulp between the wires. The chamber 42 may in principle be of the same structure as the one described in connection with the embodiment of FIG. 1. The chamber 42 shown in FIG. 2 has, however, two planar side walls 44 and 46 tapering towards the feed duct 48. The bottom wall of the chamber 42 is formed of the wires 32 and 34 and the wedge shaped gap 54 therebetween. As the side seals 40 of the apparatus extend preferably at the sides of the pressure chamber 42 forming the side plates thereof, the pressure chamber 42 is sufficiently air tight for not allowing contact of outside air with the pulp to be treated.

Figure 4:
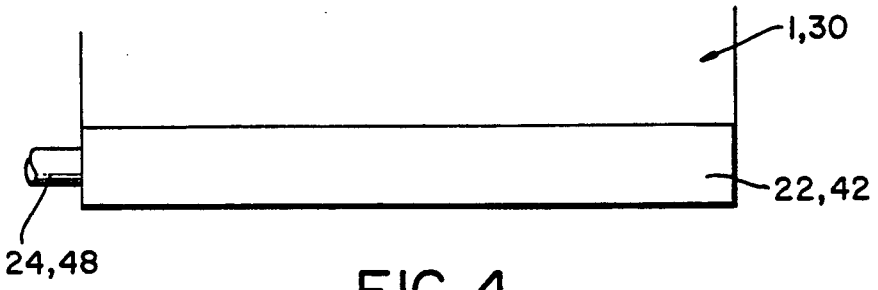
Figure 5:
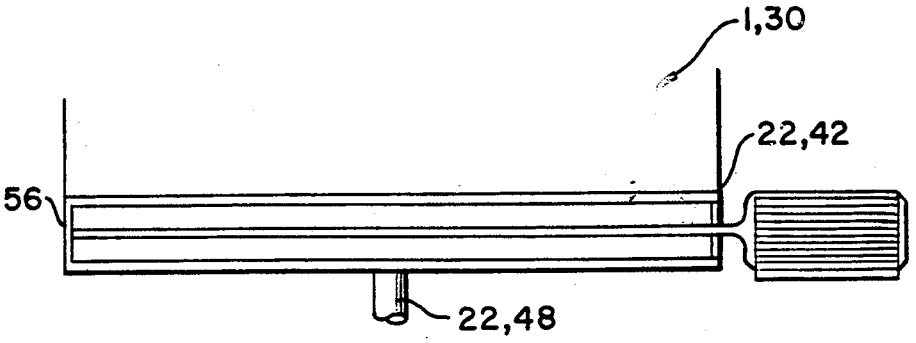
FIG. 5 is a schematic illustration showing a rotor inside the pressure chamber.

In FIGS. 3 and 4 there are shown two ways to arrange the feed of pulp to the pressure chambers 22 and 42. FIG. 3 shows that there may be either one 24, 48 or several ducts 24', 48' for feeding the pulp into the pressure chamber 22, 42. The duct 24 may be located in the center of the apparatus, whereby the pulp is divided in the middle portion of the chamber 22, 42 into two flows flowing in opposite directions thus filling the entire pressure chamber 22, 42. There may, however, be also ducts 24', 48' on both sides of the central duct 24, 48 so that the filling of the pressure chamber is ensured. Similarly, the pressure chamber may be divided in axial partitions (shown in FIG. 3*a*) such that each one of such partitions is provided with a central feed duct. FIG. 4 shows a duct 24, 48 at the end of the pressure chamber 22, 42, whereby the pulp flows along the pressure chamber 22, 42 all the way to the opposite end of the chamber. It is to be noted that in spite of the fact that only some embodiments have been shown above, also other embodiments are covered by the invention. There may be feed ducts both at the end of the pressure chamber and at the side thereof or, as shown in FIG. 5, there may be a rotating fluidizing rotor 56 arranged in the pressure chamber 22, 42 in case such seems to be needed. Such a rotating rotor may, of course, be used in connection with all kinds of treatment apparatuses, drum-type apparatuses, belt-type apparatuses etc.

Though not shown in the drawings the stationary cylindrical surface 7 shown in FIG. 1 and the chambers 10 may be omitted such that the outer housing of the apparatus faces the rotating cylinder. This is a simplified structure in case the apparatus is used only as a pulp dewatering unit. Also, it is possible to arrange the operation of the apparatus such that the chambers 10 are not used to introduce treatment liquid to the pulp in the treatment space, but to receive filtered liquid therefrom like the chambers 11 inside the rotating cylinder surface.

It is a characterizing feature of the invention that the chambers 22, 42 are limited on one of their sides, called the bottom wall, to a moving surface and its pulp treating compartment. As the pulp is introduced in a highly pressurized state in the pressure chamber the pulp is at least partially fluidized after hitting the walls of the pressure chamber, whereby the pulp is capable of filling the entire space available and forming a uniform pulp layer in the treating compartments. It is necessary for the effective operation of the feed means and for the pressure chamber that it is entirely air-tight so that the pressure or the inertial force of the pulp entering the pressure chamber cannot escape, but is utilized for spreading the pulp in the compartments.

Figure 6:
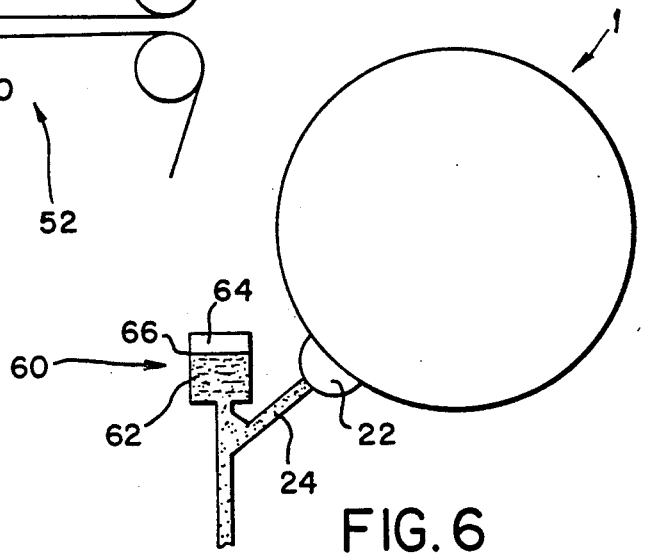
FIG. 6 is a schematic illustration showing an additional device for improving the operation of the present invention.

FIG. 6 shows an additional device arranged either in connection with the pressure chamber 22 itself or with the feed duct 24 communicating with the pressure chamber 22. The device 60 comprises a pressure balancing chamber 62 for compensating the pressure pulses created in the apparatus during the feeding of pulp therein. It has been found out that the pressure in the treatment compartment and accordingly in the pressure chamber 22 rises due to the pump pressing pulp towards the chamber. The pressure, however, drops suddenly as a new, empty treatment compartment turns towards the pressure chamber and opens thereto revealing an open space therein. By arranging said pressure balancing chamber 62 as described earlier the pump is able to push pulp into the chamber 62 against gas pressure whereby the pressure in the pressure chamber 22 does not rise that high.

The upper portion 64 of the pressure balancing chamber may be filled with air or some other appropriate gas. Said portion may be in direct communication with the pulp or it may also be separated therefrom by means of rubber bellows or like device 66.

When using the apparatus according to the invention for feeding pulp to a drum type washer, for example, it is possible to utilize the surface of the drum better in the actual washing process, because the feed and discharge apparatuses cover only 60° (degrees) of the entire drum circumference, which leaves thereby 300° (degrees) for washing. Presuming that the thickness of the web of the drum is 30 mm and the rotational speed of the drum 7.5 rpm, the square capacity of the drum becomes more than 32 BDMT/m$^2$/d. The outlet consistency may be even 15% without any risk of operational disturbances, because the discharge devices described in the parent application operate reliably at these consistencies. Thus, it is possible to treat the pulp continuously at the consistency of 8 to 20% without a need to dilute it, for example, for the feed to the washer. At the same time it is possible to utilize the feature of a fluidizing centrifugal pump to remove air from high consistency pulp, by means of which the foaming of the filtrates in the washer is prevented or minimized.

As a conclusion, it should be mentioned that the apparatus according to the invention may be applied not only to a washer, but also to other pulp treatment apparatuses, in which pulp is to be fed in the form of a web to the apparatus. Such pulp treatment apparatus may, for example, be a thickener. It must also be understood that although the above description deals only with the application of the invention solely to a drum and belt type of pulp treatment apparatus, it is quite possible to also apply the invention to other types of treatment apparatuses, in other words to all such apparatuses in which the treatment of pulp is carried out on rotating filtering surfaces. Thus, the above described example concerning a washer only has the purpose of showing what a considerable improvement the invention brings relative to the prior art and not that of restricting the invention of what is shown in the enclosed claims, which alone determine the scope of invention.

What is claimed is:

1. An apparatus for treating medium to high consistency pulp having a consistency of from 8 to 20% in a washer or some other medium to high consistency pulp treatment device such that no contact between air and the pulp is allowed during treatment, said apparatus comprising:

an outer housing which surrounds a rotating liquid pervious cylinder, said outer housing and said rotating cylinder defining therebetween a treatment space for the pulp, said treatment space being divided into a number of treatment compartments by means of substantially radial partition walls extending from said rotating cylinder towards said outer housing, said treatment compartments each having a bottom formed by said rotating liquid pervious cylinder, said filter cylinder having a number of circumferentially positioned compartments thereinside so as to receive filtered liquid from the pulp in the treatment space;

feed means for feeding said medium to high consistency pulp to said treatment compartments; and discharge means for removing pulp from said device, said feed and discharge means occupying at most 60° of the entire circumference of the rotating cylinder, said feed means including a small, substantially air-tight pressure chamber and a feed duct for supplying said medium to high consistency pulp to said pressure chamber, said pressure chamber having a bottom and a side wall, said bottom being formed by the bottom of said treatment compartment, said pressure chamber being attached by its side wall to said outer housing in an air-tight manner so as to ensure that no air contacts the pulp during treatment.

2. An apparatus as recited in claim 1, wherein said filtering means includes liquid pervious wires of a belt type pulp treatment device.

3. An apparatus as recited in claim 1, and further comprising an outer housing which surrounds a stationary liquid pervious cylindrical surface having a rotating liquid pervious cylinder therewithin, said liquid pervious cylindrical surface and said rotating cylinder defining therebetween the treatment space for pulp, said outer housing and said stationary cylindrical surface forming an outer and an inner wall of annularly arranged chambers for receiving filtered liquid from the pulp in said treatment space, said treatment space being divided into a number of treatment compartments by means of substantially radial partition walls extending from said rotating cylinder towards said stationary cylindrical surface, said pressure chamber having a bottom wall and a side wall, said chamber being attached by means of its side wall to said outer housing in an air-tight manner so that said rotating cylinder forms said bottom wall of said pressure chamber.

4. An apparatus as recited in claim 1, and further comprising an outer housing which surrounds a stationary liquid pervious cylindrical surface having a rotating liquid pervious cylinder therewithin, said liquid pervious cylindrical surface and said rotating cylinder defining therebetween the treatment space for pulp, said outer housing and said stationary cylindrical surface forming an outer and an inner wall of annularly arranged chambers for feeding treating liquid to the pulp in said treatment space, said treatment space being divided into a number of treatment compartments by means of substantially radial partition walls extending from said rotating cylinder towards said stationary cylindrical surface, said pressure chamber having a bottom wall and a side wall, said chamber being attached by means of its side wall to said outer housing in an air-tight manner so that said rotating cylinder forms said bottom wall of said pressure chamber.

5. An apparatus as recited in claim 1, wherein said housing is pressure proof.

6. An apparatus as recited in claim 1, wherein said pressure chamber extends over the entire width of said apparatus.

7. An apparatus as recited in claim 1, wherein said pressure chamber is divided axially into a number of separate pressure chambers.

8. An apparatus as recited in claim 2, and further comprising a feed end, a discharge end, said wires including a first wire arranged to travel over a first set of rolls, and a second wire arranged to travel over a second set of rolls, said wires forming a treatment space therebetween which tapers towards said discharge end and forms a wedge shaped gap therebetween at said feed end, said wires having seals at the sides thereof so as to prevent the pulp from leaking from the sides of said wires, said pressure chamber having a bottom wall and a side wall, said bottom wall being formed partially of said wires and partially of said wedge shaped gap between said wires at said feed end.

9. An apparatus as recited in claim 8, wherein said seals of said treatment space extend so as to form opposite ends of said pressure chamber, so that both said pressure chamber and said treatment space are pressure proof.

10. An apparatus as recited in claim 1, and further comprising a pressure balancing chamber in connection with said pressure chamber so as to balance pressure fluctuations in the pulp.

11. An apparatus as recited in claim 1, and further comprising a pressure balancing chamber in connection with said feed duct so as to balance pressure fluctuations in the pulp.

12. An apparatus for treating medium to high consistency pulp having a consistency of from 8 to 20% in a washer or some other medium to high consistency pulp treatment device so that no contact between air and the pulp is allowed during treatment, said apparatus comprising:

an outer housing which surrounds a rotating liquid pervious cylinder, said outer housing and said rotating cylinder defining therebetween a treatment space for the pulp, said treatment space being divided into a number of treatment compartments by means of substantially radial partition walls extending from said rotating cylinder towards said outer housing, said treatment compartments each having a bottom formed by said rotating liquid pervious cylinder, said filter cylinder having a number of circumferentially positioned compartments thereinside so as to receive filtered liquid from the pulp in the treatment space;

feed means for feeding said medium to high consistency pulp to said treatment compartment; and discharge means for removing pulp from said device, said feed and discharge means occupying at most 60° of the entire circumference of the rotating cylinder, said feed means including a small, substantially air-type pressure chamber and a feed duct for supplying said medium to high consistency pulp to said pressure chamber, said pressure chamber having a bottom and side wall, said bottom being formed by the bottom of said treatment compartment, said side wall having a first portion and a second portion, said first portion being formed by said radial partition wall of said rotating cylinder, said pressure chamber being attached by its second side wall portion to said outer housing in an airtight manner so as to insure that no air contacts the pulp during treatment.

* * * * *